United States Patent [19]

Uchida et al.

[11] 4,227,686

[45] Oct. 14, 1980

[54] APPARATUS FOR EXTRACTION OF DESIRED NUMBER OF SHEETS FOR USE IN A SHEET COUNTING MACHINE

[75] Inventors: Shinya Uchida; Junichi Arikawa, both of Tokyo, Japan

[73] Assignee: Laurel Bank Machine Co., Ltd., Tokyo, Japan

[21] Appl. No.: 52,751

[22] Filed: Jun. 28, 1979

[30] Foreign Application Priority Data

Jun. 30, 1978 [JP] Japan ..... 53-80292

[51] Int. Cl.[3] ..... B65H 3/42

[52] U.S. Cl. ..... 271/95; 235/92 SB; 414/114

[58] Field of Search ..... 271/95, 149, 160, 162; 235/92 SB; 414/114, 115, 330

[56] References Cited

U.S. PATENT DOCUMENTS

| | | | |
|---|---|---|---|
| 3,690,476 | 9/1972 | Stacy | 414/115 |
| 3,795,796 | 3/1974 | Shigemori et al. | 271/95 X |

FOREIGN PATENT DOCUMENTS

| | | | |
|---|---|---|---|
| 1012049 | 7/1952 | France | 414/114 |

*Primary Examiner*—Robert W. Saifer

*Attorney, Agent, or Firm*—Fleit & Jacobson

[57] ABSTRACT

An apparatus for extraction of a desired number of sheets for use in a counting machine for paper sheets and the like, wherein paper sheets held in a stack between a holder and a paper-pressing bar are sucked and counted one at a time by respective suction heads provided on a rotational cylinder, a desired number of counted sheets on the side of the pressing bar being extracted from the machine by a separator which separates the counted sheets from the remaining sheets in a stack when the desired number of sheets have been counted. The apparatus for extracting a desired number of sheets comprises an operational mechanism incorporating a solenoid and associated members which is operated in cooperation with the action of said separator which separates the desired number of counted paper sheets from the remaining paper sheets so as to move said paper-pressing bar in a direction away from said holder and which can be reset to its original state. The associated members includes a link connecting the pressing bar for holding the paper sheets in cooperation with the holder with the solenoid, and a no paper sheet detecting device comprising an LED and a photosensor positioned so that it operates when the pressing bar is away from the holder and paper sheets are not present on the pressing bar.

2 Claims, 4 Drawing Figures

APPARATUS FOR EXTRACTION OF DESIRED NUMBER OF SHEETS FOR USE IN A SHEET COUNTING MACHINE

BACKGROUND OF THE INVENTION

This invention relates to an apparatus for extracting a desired number of sheets for use as an apparatus in a counting machine or bank note counter for counting paper sheets and the like.

In conventional counting machines for counting paper sheets and the like, paper sheets, which are held in the form of a stack between a holder and a paper-pressing bar, are sucked and counted one at a time by suction heads provided on a rotary cylinder, and, when a desired number of sheets have been counted out from the paper sheet stack, these counted paper sheets are automatically separated from the remaining paper sheets by a separator so that the desired number of paper sheets, which now lie on the side of the paper-pressing bar, can be extracted from the machine. Conventionally, the extraction of a desired number of paper sheets which have been separated from the remaining paper sheets by the separator is accomplished by grasping the separated sheets by hand and depressing a reset button to release the holding action of the holder and the paper-pressing bar, thus allowing the paper sheets to be extracted from the machine. In a case where several groups of a desired number of paper sheets are to be extracted, a first group of the desired number of sheets, which has been separated from the remaining sheets, is grasped by hand, the reset button is depressed to extract the group, and the remaining paper sheets are set on the holder again. Thereafter, a second group is separated from the remaining sheets and grasped by hand, and the reset button is depressed to extract the group. These steps being repeated a number of times. Accordingly, in the prior art, the paper sheet extraction operation has been inefficient, cumbersome and time-consuming.

SUMMARY OF THE INVENTION

It is therefore an object of the present invention to provide an apparatus for extracting several groups of a desired number of sheets, which apparatus allows the simple extraction of several groups of a desired number of paper sheets merely by the separating operation of a separator without the labor required in the prior art, as well as a highly efficient extraction operation in the case of the continous extraction operation the sheets being extracted with case without disturbing the paper sheets in a stack. According to the present invention, there is provided a counting machine for paper sheets and the like wherein paper sheets held in a stack between a holder and a paper-pressing bar are sucked and counted one at a time by respective suction heads provided on a rotational cylinder, a desired number of counted sheets on the side of the pressing bar being extracted from the machine by a separator which separates the counted sheets from the remaining sheets in a stack when the desired number of sheets have been counted. The apparatus for extracting a desired number of sheets comprises an operational mechanism incorporating a solenoid and associated members which is operated in cooperation with the action of said separator of separating the desired number of counted paper sheets from the remaining paper sheets as to move said paper-pressing bar in the direction away from said holder and which can be reset to its original state, whereby the desired number of paper sheets can be extracted under a condition where they are distant from the remaining paper sheets.

BRIEF DESCRIPTION OF THE DRAWING

The invention will now be described in connection with an embodiment thereof with reference to the accompanying drawings wherein.

Figure 1:
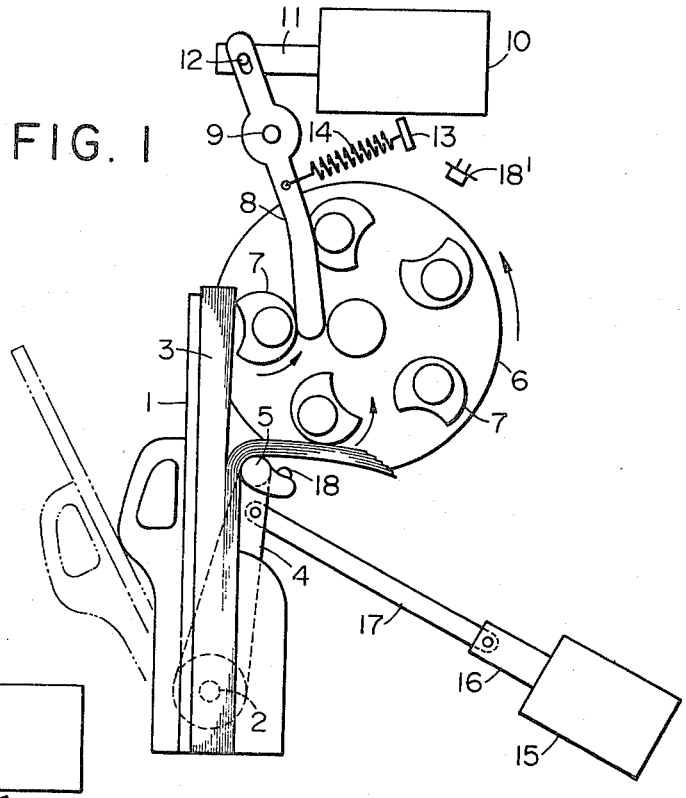
FIG. 1 is a plan view of the essential portion of the apparatus.

Reference numeral 1 indicates a holder which is supported for rotation about a support shaft 2. A stack of paper sheets 3 can be set on the holder 1 with the holder in the open state as shown by the phantom line in FIG. 1, and the paper sheets can be counted with the holder in the closed as shown by the solid line. An arm 4 is supported for rotation about the support shaft 2 and is provided on its top end with a paper-pressing bar 5 projecting therefrom. In counting paper sheets the paper-pressing bar 5 is resiliently urged toward the paper sheet stack 3 such that the paper sheet stack 3 is held between the holder 1 and the paper-pressing bar 5. The foregoing construction is similar to that of the conventional apparatus. Provided in the vicinity of the above-described members is a rotary cylinder 6 having a plurality of suction heads 7 mounted along its periphery each of the heads 7 being freely rotatable. This construction is also similar to that of the conventional apparatus.

Reference numeral 8 indicates a separator consisting of a rod, which is pivoted for rotation about a fulcrum 9 so that the end of the separator 8 can come into contact with a side face of the paper sheet stack 3 lying on a side face of the forward portion of the holder 1, thereby to allow separation of the paper sheets. The other end of the separator 8, which extends from the fulcrum 9, is connected through a pin 12 to an actuator 11 of a solenoid 10, with the above-mentioned end of the separator 8 being connected through a tension spring 14 to a support member 13. Accordingly, this end of the separator 8 will be brought into pressing contact with the paper sheet stack 3 by the attracting action of the solenoid 10 and will be moved away from the paper sheet stack 3 by the pulling force of the tension spring 14 when the separator is released from the attracting action of the solenoid 10.

Reference number 15 indicates a solenoid for attracting the paper-pressing bar 5. The actuator 16 of the solenoid 15 is connected through a link 17 to the top portion of the arm 4 so that the arm 4 will be pulled and hence rotated by the attracting action of the solenoid 15 acting through the link 17, with the paper-pressing bar 5 being moved in the direction away from the holder 1. On the upper portion of the paper-pressing bar 5 and on the side above the rotational cylinder 6 are provided no paper sheet detecting device comprising a LED and photosensor 18 and 18', when the detecting device 18, 18′ operate in coincidence with respect to each other under a condition where the paper-pressing bar 5 has been pulled and moved by the solenoid 15 and the group of the paper sheets has been extracted, the attracting action of the solenoid 15 will be eliminated.

Figure 3:
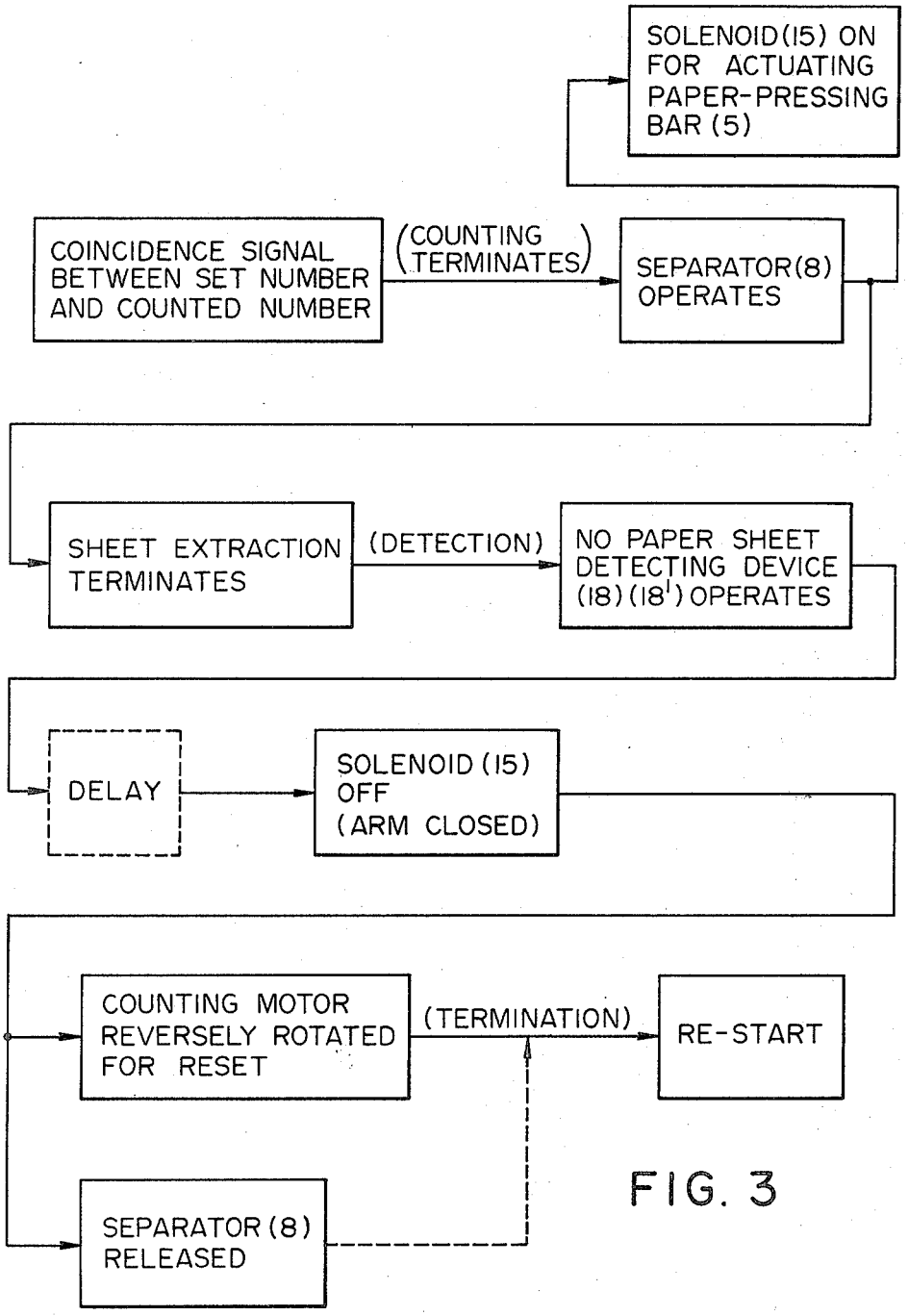
FIG. 3 is a block diagram showing the operational procedure of the apparatus.
Figure 4:
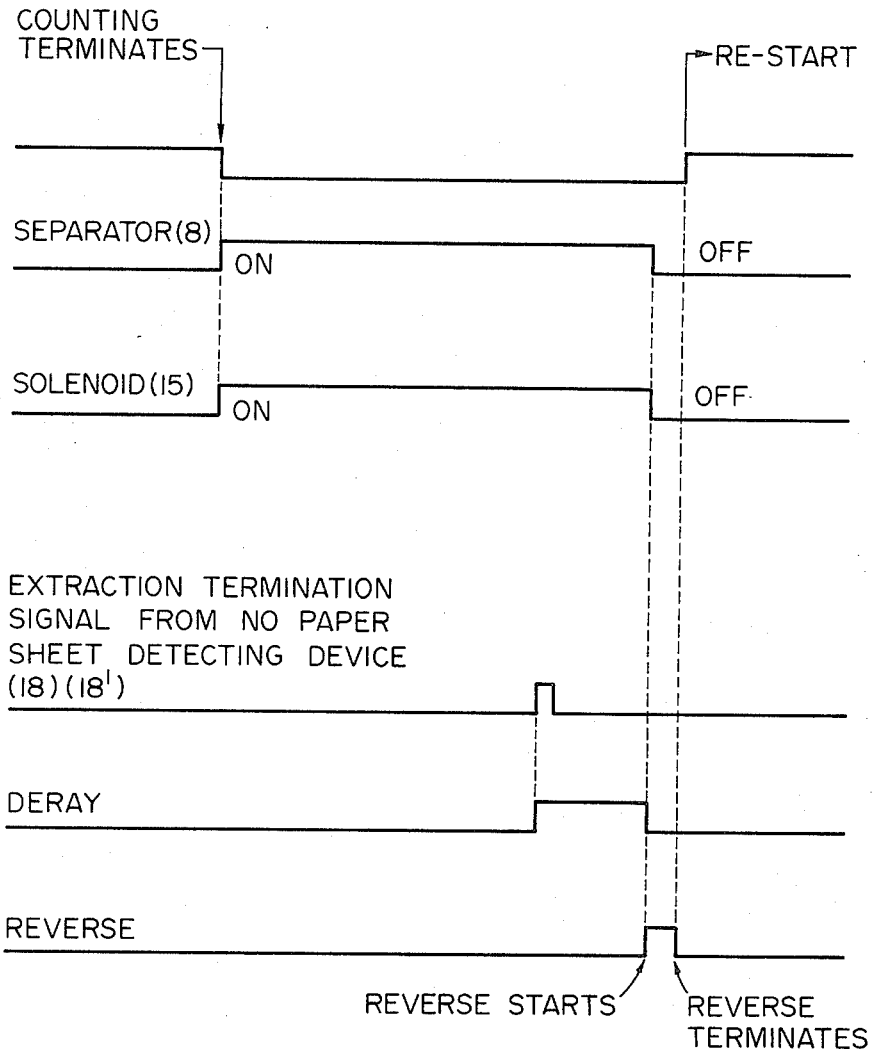
FIG. 4 is a diagram for describing the associated signals. cl DESCRIPTION OF THE PREFERRED EMBODIMENT One embodiment of the present invention will be now described in detail with the reference to the accompanying drawings.

FIG. 3 is a block diagram for explaining the operation of the apparatus of the invention, and FIG. 4 is a diagram for describing the associated signals. When the paper sheet stack 3 is set on the holder 1 which occupies the position shown by the phantom line in FIG. 1 and a start button (not shown) is depressed, the rotary cylinder 6 and the respective suction heads 7 rotate under the state where the separator 8 is pulled by the tension spring 14 in the direction away from the holder 1 and under the state where the paper sheet stack 3 is held between the holder 1 and the paper-pressing bar 5 which resiliently presses, due to elimination of the attracting action of the solenoid 15, the paper sheet stack 3 against the holder 1, thereby to count the paper sheets one at a time in such a manner that each of the paper sheets is sucked and turned over or deflected by the suction heads 7, as shown in FIG. 1.

Then the counted number of paper sheets reaches a desired value which has been pre-set, this desired number of paper sheets can then be extracted out of the apparatus, as can be seen from the operational procedure shown in FIG. 3.

Figure 2:
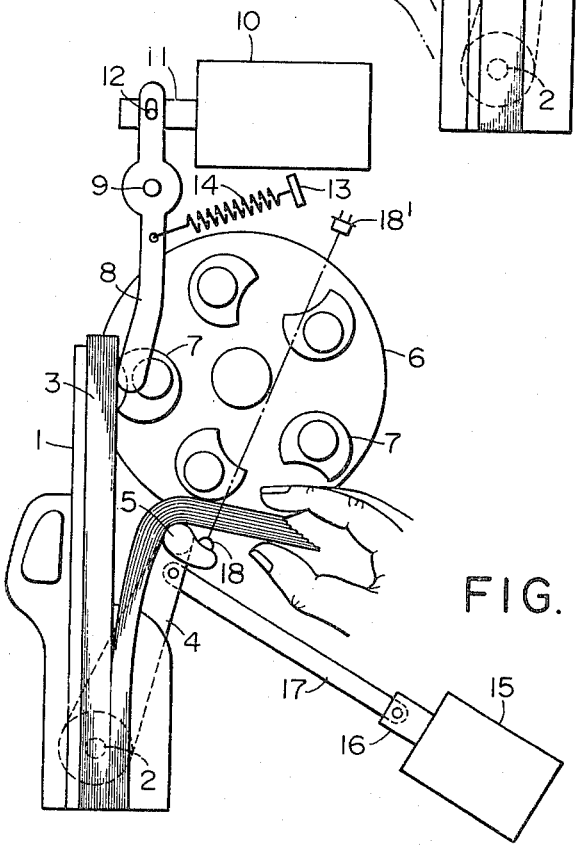
FIG. 2 is an explanatory view showing the operation of the apparatus.

This operation will now be described in connection with FIG. 2. When a desired number of the paper sheets is counted, the solenoid 10 is actuated to rotate the separator 8 thereby to cause the separator 8 to press against and hold the stack of paper sheets 3, which remain lying on the holder 1, in order to separate the counted sheets from the remaining sheets. In concurrence with this, the solenoid 15 is actuated to move the paper-pressing bar 5 in the direction away from the holder 1, whereby the desired number of paper sheets, which have been turned over around the paper-pressing bar 5, can be extracted by grasping them by the fingers, as shown in FIG. 2. As there is a clearance between the group of the desired number of paper sheets and the group of paper sheets which remain lying on the holder 1, the first mentioned group of paper sheets can be easily extracted. The other group of paper sheets remaining on the holder 1 is pressed and held by the separator 8, and thus remains on the holder 1 without being disturbed.

The fact that the paper sheets have been taken out is detected by the no paper sheet detecting device 18, 18′ which cooperate with each other as shown by the chain line in FIG. 2. As a result, the attracting action of the solenoid 15 is eliminated again to allow the paper-pressing bar 5 to press against the stack of paper sheets 3 remaining on the holder 1. The separator 8 moves away from the paper sheet stack 3, thus enabling the next counting operation. Thus, succeeding groups of a desired number of paper sheets can in turn be counted and extracted in a similar manner.

As will be apparent from the above description, in a counting machine wherein paper sheets are held in the form of a stack between the holder and the paper-pressing bar and are sucked and counted one at a time up to desired number by the respective suction heads on the rotary cylinder, the counted paper sheets being separated from the remaining paper sheets and becoming capable of being extracted from the machine, according to the invention there is provided an operational mechanism incorporating a solenoid and associated members which is operated in cooperation with the paper sheet separating operation as to move the paper-pressing bar in the direction away from the holder, and which can be reset thereafter to its original state. Accordingly, upon counting up to a desired number of sheets which has been pre-set, the number of counted paper sheets are brought, by the movement of the paper-pressing bar, into a condition where they are separated from the remaining paper sheets and capable of being extracted with ease white in this condition. Similar counting and extraction operations can be carried out in succession in an efficient manner. The paper sheets remaining on the holder are effectively held by the separator without being disturbed when the counted number of paper sheets are extracted, thus facilitating the succeeding counting and extraction operations. Thus, according to the invention, can be counted and extracted with a simple construction.

What is claimed is:

1. In a counting machine for paper sheets and the like wherein paper sheets held in a stack between a holder and a paper-pressing bar are sucked and counted one at a time by respective suction heads provided on a rotational cylinder, a desired number of counted paper sheets on the side of the presssing bar being extracted from the machine by a separator which separates the counted sheets from the remaining sheets in a stack when the desired number of sheets have been counted; an apparatus for extracting a desired number of sheets comprising an operational mechanism incorporating a solenoid and associated members which is operated in cooperation with the action of said separator which separates the desired number of counted paper sheets from the remaining paper sheets so as to move said paper-pressing bar in a direction away from said holder and which can be reset to its original state, whereby the desired number of paper sheets can be extracted under a condition where they are distant from the remaining paper sheets.

2. The apparatus as set forth in claim 1 wherein said associated members includes a link connecting the pressing bar for holding the paper sheets in cooperation with the holder with the solenoid, and a no paper sheet detecting device comprising an LED and a photosensor positioned so that it operates when the pressing bar is away from the holder and paper sheets are not present on the pressing bar.

* * * * *